US005565082A

United States Patent [19]

Nakamatsu et al.

[11] Patent Number: 5,565,082

[45] Date of Patent: Oct. 15, 1996

[54] BRINE ELECTROLYSIS AND ELECTROLYTIC CELL THEREFOR

[75] Inventors: Shuji Nakamatsu; Yoshinori Nishiki, both of Kanagawa, Japan

[73] Assignee: Permelec Electrode Ltd., Kanagawa, Japan

[21] Appl. No.: 325,612

[22] Filed: Oct. 19, 1994

[30] Foreign Application Priority Data

Oct. 27, 1993 [JP] Japan ..... 5-292646

[51] Int. Cl.[6] ..... C25B 1/34

[52] U.S. Cl. ..... 205/531; 205/532; 204/265

[58] Field of Search ..... 204/98, 128, 129, 204/265; 205/532, 533, 526

[56] References Cited

U.S. PATENT DOCUMENTS 3,423,247 1/1969 Darland et al. ..... 136/120
4,221,644 9/1980 LaBarre ..... 204/98
4,486,276 12/1984 Cohn et al. ..... 204/98
4,578,159 3/1986 Miles et al. ..... 204/98
5,015,344 5/1991 Nidola et al. ..... 204/98
5,372,689 12/1994 Carlson et al. ..... 204/283

FOREIGN PATENT DOCUMENTS 0047080 3/1982 European Pat. Off. .

*Primary Examiner*—Kathryn Gorgos
*Attorney, Agent, or Firm*—Sughrue, Mion, Zinn, Macpeak & Seas

[57] ABSTRACT

A method for brine electrolysis using a gas electrode and an electrolytic cell therefor, in which gas electrode 31 permeable to gas and liquid is arranged in cathode chamber 24 in contact with ion-exchange membrane 22. Sodium hydroxide produced on electrode substance 30 of gas electrode 31 easily penetrates the gas electrode and is recovered from the cathode chamber. No sodium hydroxide is produced within the ion-exchange membrane so that penetration of sodium hydroxide into the anode chamber is thereby prevented.

4 Claims, 2 Drawing Sheets

BRINE ELECTROLYSIS AND ELECTROLYTIC CELL THEREFOR

FIELD OF THE INVENTION

This invention relates to brine electrolysis using a gas electrode and an electrolytic cell therefor. More particularly, it relates to a method for producing a sodium hydroxide aqueous solution by the electrolysis of brine using a gas electrode at a high current efficiency and in a stable manner, and to an electrolytic cell for use in carrying out the method.

BACKGROUND OF THE INVENTION

With the recent remarkable development and improvement of fluorine type ion-exchange membranes, electrolysis of sodium chloride solutions using an ion-exchange membrane as a diaphragm has become widespread. This technique is a method for producing hydrogen gas and sodium hydroxide in a cathode chamber and chlorine gas in an anode chamber by electrolysis of brine.

To reduce energy consumption, the use of a gas electrode as a cathode to conduct electrolysis while supplying oxygen to a cathode chamber to suppress hydrogen evolution and to greatly reduce cell voltage has been proposed, e.g., in JP-A-52-124496 (the term "JP-A" as used herein means an "unexamined published Japanese patent application"), JP-B-2-29757 (the term "JP-B" as used herein means an "examined published Japanese patent application"), and JP-A-62-93388. In theory, cell voltage can be reduced by 1.2 V or more by converting a cathodic reaction with no supply of oxygen as represented by formula (1) to a reaction with oxygen supply as represented by formula (2):

$$2H_2O+2e^- \rightarrow H_2+2OH^- \text{ (E=−0.83 V vs. NHE)} \quad (1)$$

$$H_2O+1/2O_2+2e^- \rightarrow 2OH^- \text{ (E=0.40 V vs. NHE)} \quad (2)$$

In general, a gas electrode is placed in a cathode chamber to partition the chamber into a solution chamber on an ion-exchange membrane side and a gas chamber on the opposing side. The gas electrode is usually prepared by molding a mixture of a hydrophobic substance, such as a polytetrafluoroethylene resin (hereinafter abbreviated as PTFE), and a catalyst or a catalyst-on-carrier, and its hydrophobic property hinders permeation of the liquid. However, the gas electrode gradually loses its hydrophobic property when exposed to a high temperature of around 90° C. and a sodium hydroxide aqueous solution in a high concentration of about 32% by weight during long-term electrolysis. As a result, the liquid of the solution chamber begins to leak into the gas chamber. Furthermore, since the gas electrode is made of a mixture mainly comprising a carbon material and a resin, the gas electrode is mechanically brittle and tends to crack. These disadvantages have prevented practical use of a gas electrode for brine electrolysis.

FIG. 1 illustrates an electrolytic cell using a conventional gas electrode. Electrolytic cell 1 is partitioned by ion-exchange membrane 2 into anode chamber 3 and cathode chamber 4. Porous anode 5 is set close to ion-exchange membrane 2 in anode chamber 3. Anode chamber 3 has inlet 6 for feeding brine (a saturated sodium chloride aqueous solution) on the lower side wall thereof, outlet 7 for withdrawing a dilute salt water on the upper side wall thereof, and outlet 8 for withdrawing chlorine gas on the top thereof.

Cathode chamber 4 is equipped with gas electrode 11 comprising sheet substrate 9 having formed thereon electrode substance 10 comprising a mixture of a carbon material and PTFE, in such manner that cathode chamber 4 is partitioned into solution chamber 12 on the side of electrode substance 10 and gas chamber 13 on the side of substrate 9. Solution chamber 12 has inlet 14 for feeding a dilute aqueous solution of sodium hydroxide at the bottom thereof and outlet 15 for withdrawing a saturated sodium hydroxide aqueous solution at the top thereof. Gas chamber 13 has inlet 16 for feeding an oxygen-containing gas on the side wall thereof and outlet 17 for discharging an oxygen-containing gas at the bottom thereof.

Electolysis using a cell of this type is carried out by feeding brine to anode chamber 3 from inlet 6, a dilute sodium hydroxide aqueous solution to solution chamber 12 from inlet 14, and an oxygen-containing gas, such as air, to gas chamber 13 from inlet 16. Meanwhile, gas electrode 11, comprising sheet substrate 9 having thereon a layer of electrode substance 10, is damaged by the high temperature of the electrolytic solution and the concentrated sodium hydroxide aqueous solution generated by electrolysis. As a result, substance 9 and electrode substance 10 are deteriorated and fail to withstand long-term operation.

In order to solve the above-mentioned problem association with this type of an electrolytic cell, it has been proposed to unite a gas electrode with an ion-exchange membrane into an integral structure (hereinafter referred to as an integral gas electrode/ion-exchange resin type cell) without partitioning the cathode chamber, as disclosed in JP-B- 61-6155. According to this method, the gas electrode reinforced by the ion-exchange membrane is said to overcome the mechanical brittleness. However, highly concentrated sodium hydroxide which is produced on the surface of the cathode, i,e., in the vicinity or on the surface of the ion-exchange membrane, penetrates the ion-exchange membrane and enters the anode chamber. This results not only in a reduction in current efficiency for sodium hydroxide production, but also presents the possibility of damage to the member constituting the anode chamber which usually has no alkali resistance. On the other hand, the sodium hydroxide produced on the surface of the ion-exchange membrane must permeate the gas electrode to allow for its recovery. However, it is extremely difficult to recover the sodium hydroxide while also feeding an oxygen-containing gas in sufficient amount to the gas chamber.

SUMMARY OF THE INVENTION

An object of the present invention is to provide a method of brine electrolysis using a gas electrode having satisfactory strength and which effectively prevents sodium hydroxide produced during electrolysis from permeating into an anode chamber.

The present invention provides a method of brine electrolysis using an electrolytic cell comprising an ion-exchange membrane which partitions the cell into an anode chamber and a cathode chamber, a porous anode arranged in the anode chamber, and a gas electrode bonded to a conductive porous body arranged in the cathode chamber, comprising the steps of supplying brine to the anode chamber, and an oxygen-containing gas to the cathode chamber and electrolyzing the brine to obtain chlorine gas from the anode chamber and an aqueous sodium hydroxide solution from the cathode chamber, wherein the gas electrode is permeable to gas and liquid and is in contact with the ion-exchange membrane.

The present invention also provides an electrolytic cell which can be used for carrying out the above described method.

DETAILED DESCRIPTION OF THE INVENTION

Figure 1:
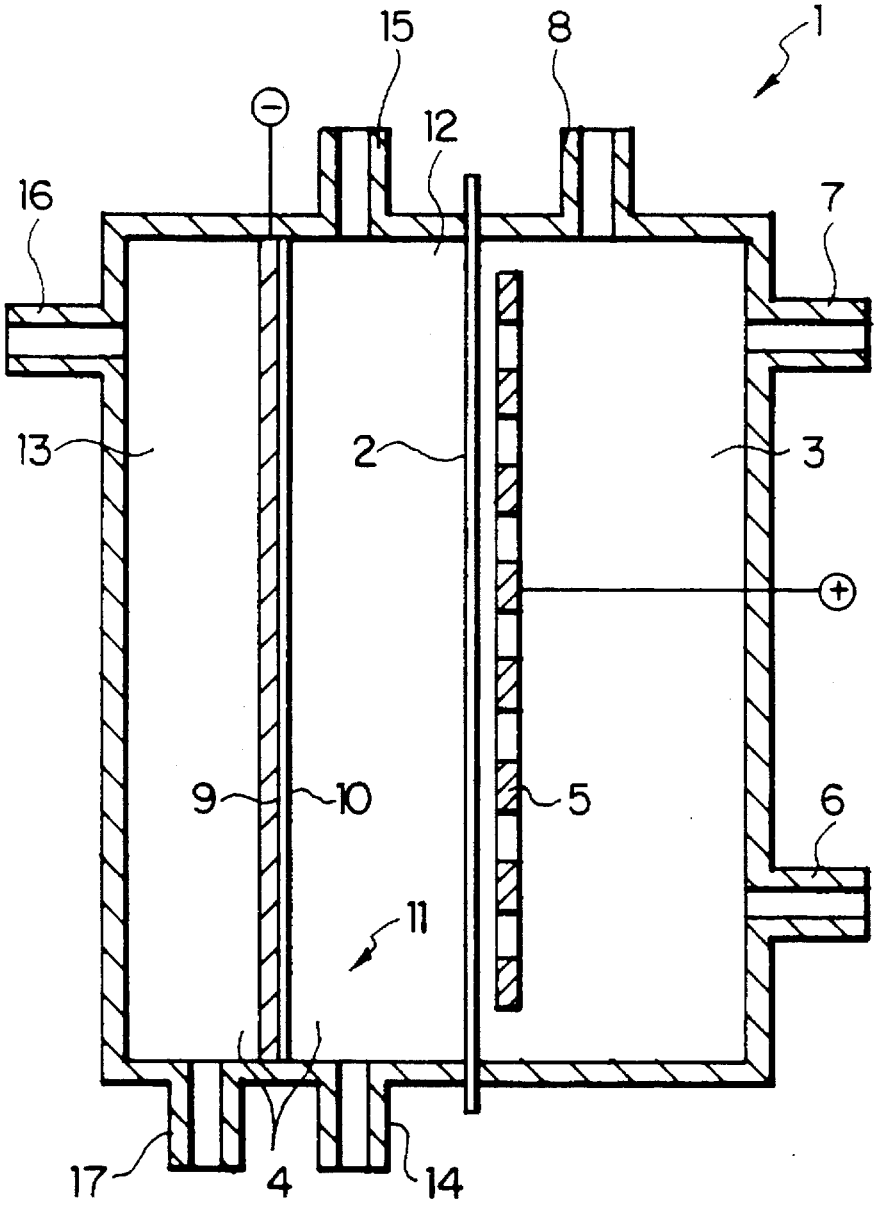
FIG. 1 PRIOR ART
FIG. 1 is a longitudinal cross section of an illustrative example of a conventional electrolytic cell using a gas electrode.

In the present invention, a gas-liquid permeable gas electrode is used in place of a conventional gas-liquid-impermeable electrode so as to eliminate the disadvantages of an integral gas electrode/ion exchange membrane type conventional electrolytic cell. The gas electrode of the present invention prevents a concentrated sodium hydroxide aqueous solution produced during electrolysis from remaining in the vicinity of the interface between an ion-exchange membrane and a gas electrode and from permeating the ion-exchange membrane into an anode chamber. In contrast, in a conventional cell, the sodium hydroxide produced during electrolysis substantially does not permeate a gas electrode into a cathode chamber, but instead tends to penetrate into an anode chamber. On the other hand, the gas electrode used in the present invention allows the sodium hydroxide produced during electrolysis to penetrate into a cathode chamber and to be recovered therefrom with ease. As a result, high current efficiency in sodium hydroxide production is maintained, and the non-alkali resistant member of the anode chamber is protected from alkali.

Thus, the gas electrode for use in the present invention is gas-liquid permeable and, in this respect, is fundamentally different from a conventional gas-liquid impermeable gas electrode. In more detail, a pressure required for the liquid permeation in the gas-liquid permeable gas electrode of the present invention is below 0.1 kgf/cm$^2$, which is very lower than that in a conventional gas-liquid-impermeable gas electrode (about 1 kgf/cm$^2$ or less). Specific examples of gases to which the gas electrode of the present invention is permeable are air, oxygen, hydrogen, carbon dioxide, and the like, and a specific examples of liquids to which the gas electrode of the present invention is permeable are water, methanol, salt-dissolved electrolyte, and the like. The gas electrode of the present invention cannot be prepared by a conventional process generally employed for gas electrodes; rather, a specifically designed process is required. While the gas-liquid permeable gas electrode for use in the present invention is by no means limited by the process of production, it may be prepared, for example, by (i) coating one or both sides of a conductive material having fine pores of from about 1 to about 100 μm, such as carbon cloth, metal fiber or a metal sinter, with a mixture comprising carbon powder and a water-repellent material, e.g., PTFE, with the ratio of the carbon powder to the water-repellent material being from about 5.0 to about 1.0 in weight, (ii) calcining the coating layer to form a gas diffusing layer, and (iii) forming a catalyst layer, such as platinum or silver, by pyrolysis on the surface of the gas diffusing layer on the side in contact with an ion-exchange membrane or forming a catalyst-bearing thin layer of carbon powder and PTFE on that surface.

A conductive porous body of the invention which supplies electricity to the gas electrode is prepared from an alkali-resistant material, preferably a metal such as stainless steel or nickel. Carbon materials may also be employed as the conductive porous body. The conductive porous body preferably has the form of an expanded mesh, woven mesh, punching metal, metallic fiber web, cloth, etc. Sintered metals and foamed metals (commercially available under the trade name of "CELMET" a porous material wherein the skeleton has a three-dimensional network comprising Ni or Ni—Cr), produced by Sumitomo Electric Industries, Ltd.) are also suitable.

The ion-exchange membrane for use in the present invention includes those produced by E. I. Du Pont de Nemours and Company for brine electrolysis, such as "NAFION 901" a (perflourosulfonic acid cation exchange membrane), "NAFION 90209" (a perfluorosulfonic acid cation exchange menbrane) and "NAFION 961" (a perfluorosulfonic acid cation exchange membrane). An ion-exchange membrane FX-50, produced by Asahi Glass Co., Ltd. for high concentration soda, is also preferred for its resistance to sodium hydroxide.

The electrolytic cell assembled from the above-described members may be installed either horizontally or vertically. In the former case, the cell is preferably set under the ion-exchange membrane so that sodium hydroxide produced during electrolysis substantially does not remain at the gas electrode.

The oxygen-containing gas (oxygen content: about 20–100 vol %) supplied to the cathode chamber, such as air, oxygen-enriched air or oxygen, is preferably humidified to have a water content of from about 10 to about 90 vol % before introduction into the electrolytic cell. The water content in the gas is preferably controlled by passing the gas through a water vessel which is kept at a temperature of from about 30 to about 100° C. The concentration of sodium hydroxide produced during electrolysis can be controlled by the humidity of the oxygen-containing gas. It is also preferable to remove carbon dioxide from air prior to introduction into an electrolytic cell.

Brine is supplied to the anode chamber, and a dilute sodium hydroxide aqueous solution and an oxygen-containing gas is supplied to the cathode chamber. Upon applying a voltage, chlorine gas is generated from the brine supplied to the anode chamber, while in the cathode chamber hydrogen ions react with oxygen to form water to thereby suppress hydrogen evolution. At the same time, sodium hydroxide is produced on the catalyst of the gas electrode having gas-liquid permeability in contact with the ion-exchange membrane. The thus produced sodium hydroxide permeates the gas electrode, migrates to the cathode chamber on the opposing side, and is easily removed from the cathode chamber. Since the gas electrode is not an integral part of the ion-exchange membrane but is only in contact therewith, sodium hydroxide not produced within the ion-exchange membrane. As a result, sodium hydroxide permeation into the anode chamber is surely prevented.

Since the gas electrode is in contact with the ion-exchange membrane, it is reinforced by the ion-exchange membrane in a manner similar to a conventional gas electrode integrated with an ion-exchange membrane. Therefore, the gas electrode of the invention resists mechanical deterioration even in long-term use, thus allowing electrolysis to be carried out continuously and in a stable manner. Furthermore, by employing a two-chamber structure just as in the integral gas electrode/ion-exchange membrane type cell, the electrolytic cell of the present invention achieves simplification of the structure and piping of the cell per se as compared to a three-chamber structure.

An illustrative example of the brine electrolysis cell of the present invention is explained below by reference to the accompanying drawing.

In the drawing, a powder supply which follows a current to the cell is connected to an anode and a cathode (⊕ and ⊕). A current density applied to the membrane is from 10 to 50 A/dm$^2$.

Figure 2:
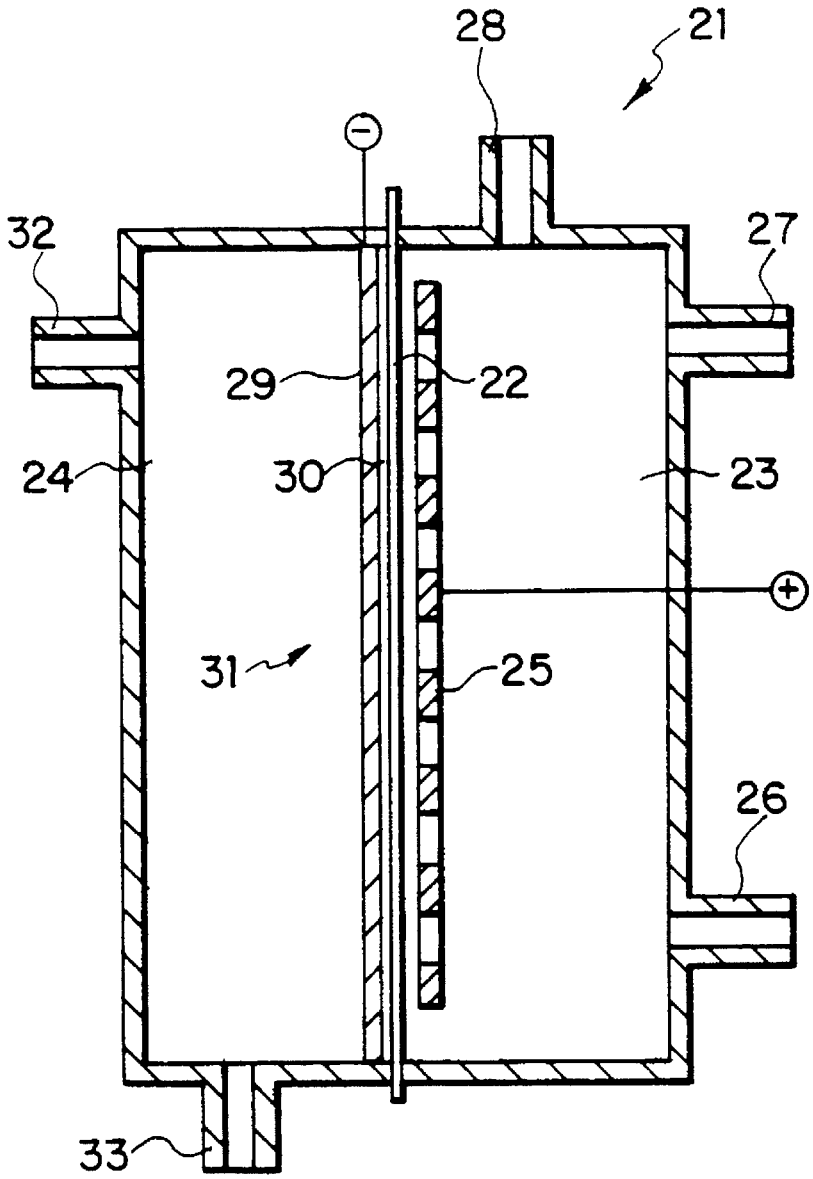
FIG. 2 is a longitudinal cross section of an illustrative example of the electrolytic cell according to the present invention.

FIG. 2 shows a longitudinal cross section of one example of the electrolytic cell of the present invention. Electrolytic cell 21 comprises anode chamber 23 and cathode chamber 24, partitioned by ion-exchange membrane 22. Porous anode 25 is set in anode chamber 23 in the vicinity of ion-exchange member 22. Anode chamber 23 has inlet 26 for feeding brine at the lower part thereof, outlet 27 for withdrawing a dilute brine at the upper part thereof, and outlet 28 for withdrawing chlorine gas on the top thereof.

Cathode chamber 24 is equipped with gas-liquid permeable gas electrode 31 comprising substrate 29 (such as a porous sheet) having formed thereon electrode substance 30 comprising a mixture of a carbon material and PTFE. Cathode chamber 24 has inlet 32 for feeding an oxygen-containing gas and a dilute sodium hydroxide aqueous solution on the side wall thereof and outlet 33 for withdrawing an oxygen-containing gas and a saturated sodium hydroxide aqueous solution at the bottom thereof.

Electrolysis is carried out by feeding brine to anode chamber 23 from inlet 26 and a dilute sodium hydroxide aqueous solution and an oxygen-containing gas to cathode chamber 24 from inlet 32. A current is given from the anode to the cathode. Sodium hydroxide thus produced on the surface of electrode substance 30 permeates gas electrode 31 into cathode chamber 24 substantially without permeating ion-exchange membrane 22 into anode chamber 23. As a result, electrolysis can be performed with no loss of sodium hydroxide thus produced to obtain sodium hydroxide at high efficiency.

The present invention will now be illustrated in greater detail with reference to Examples, but it should be understood that the present invention is not deemed to be limited thereto.

EXAMPLE 1

A circular electrolytic cell having the structure shown in FIG. 2 (effective area: 1 dm$^2$) was assembled using the following members in the order of a conductive porous body for cathode/gas electrode (cathode)/ion-exchange membrane/anode with the catalyst layer of the gas electrode in contact with the ion-exchange membrane.

Anode:

A coating layer comprising ruthenium oxide and titanium oxide (ruthenium content: 8 g/m$^2$, and titanium content: 8 g/m$^2$) was formed by pyrolysis on an expanded titanium mesh having a longer diameter of 8 mm, a shorter diameter of 3.6 mm and a thickness of 1.2 mm.

Cathode:

Carbon cloth PWB-3, produced by Zoltek Co., as a substrate was coated with a mixture of carbon powder XC-72, produced by Cabot G. L. Inc., and a Teflon suspension 30J (2:1 in weight ratio), produced by Du Pont-Mitsui Fluorochemicals Co., Ltd., and hot-pressed. An allyl alcohol solution (special grade, produced by Wako Pure Chemical Industries, Ltd.) of chloroplatinic acid (concentration: 100 g/l) was applied to one side of the substrate and pyrolyzed at 300° C. to form a catalyst layer.

Conductive Porous Body for Cathode:

Nickel Celmet produced by Sumitomo Electric Industries, Ltd.

Ion-Exchange Membrane:

"NAFION 901" (a perfluorosulfonic acid cation exchange membrane), produced by E. I. du Pont de Nemours & Co.

Humidified oxygen gas at 80° C. was supplied to the cathode chamber. A saturated sodium hydroxide aqueous solution purified by chelation was supplied to the anode chamber. Electrolysis conducted at 80° C. and 30 A/dm$^2$. The cell voltage was 2.30 V. A 25 wt % sodium hydroxide aqueous solution was obtained from the cathode chamber at a current efficiency of 93%. The electrolysis was continued for 50 days and no deterioration in performance was observed.

COMPARATIVE EXAMPLE 1

Electrolysis was carried out under the same conditions as in Example 1, except for using a commercially available gas-liquid impermeable gas electrode, produced by Tanaka Kikinzoku Kogyo K. K. The gas electrode was arranged to partition the cathode chamber into a solution chamber and a gas chamber as shown in FIG. 1, with the other members being the same as those used in Example 1. The cell voltage was 2.30 V at the start of electrolysis but began to increase from the 10th day. On the 30th day, the cell voltage exceeded 3.0 V so that electrolysis was discontinued. From about the 10th day, sodium hydroxide was detected as a waste liquid withdrawn from the gas chamber of the cathode chamber. The cell was disassembled and cracks were found in the gas electrode, indicating that sodium hydroxide had leaked from the solution chamber.

Because the gas electrode for use in the present invention is permeable to both gas and liquid, sodium hydroxide produced on the catalyst of the gas electrode in contact with an ion-exchange membrane permeates the gas electrode, enters the cathode chamber on the opposing side of the gas electrode, and is readily removed from the cathode chamber. Because the gas electrode only is in contact with the ion-exchange membrane but is not integrated therewith, sodium hydroxide is not produced within the ion-exchange membrane. This arrangement prevents permeation of sodium hydroxide into the anode chamber.

Since the gas electrode is reinforced by contact with the ion-exchange membrane, it suffers little mechanical deterioration even in long-term use. As a result, making it electrolysis may be conducted continuously for an extended period of time and in a stable manner. Furthermore, by employing a two-chamber structure just as in the integral gas electrode/ion-exchange membrane type cell, the electrolytic cell of the present invention achieves simplification of the structure and piping of the cell per se as compared to a three-chamber structure.

While the invention has been described in detail and with reference to specific examples thereof, it will be apparent to one skilled in the art that various changes and modifications can be made therein without departing from the spirit and scope thereof.

What is claimed is:

1. A method of brine electrolysis using an electrolytic cell comprising an ion-exchange membrane which partitions the cell into only two chambers which are an anode chamber and a cathode chamber, a porous anode arranged in the anode chamber, and a porous cathode consisting essentially of a gas electrode bonded to a conductive porous body arranged in the cathode chamber, comprising the steps of:

supplying brine to the anode chamber and an oxygen-containing gas to the cathode chamber and electrolyzing the brine to obtain chlorine gas from the anode chamber and sodium hydroxide aqueous solution from the cathode chamber, wherein said gas electrode is permeable to both gas and liquid through pores or channels distributed or constructed in the body and is in contact with said ion-exchange membrane not an integral part of said membrane.

2. The method of claim 1, wherein said oxygen-containing gas is a humidified gas.

3. An electrolytic cell for brine electrolysis comprising an ion-exchange membrane which partitions the cell into only two chambers which are an anode chamber and a cathode chamber, a porous anode arranged in said anode chamber, and a porous cathode consisting essentially of a gas diffusion layer having a catalyst layer thereon bonded to a conductive porous body arranged in said cathode chamber and in contact with said ion-exchange membrane where said cathode is permeable to both gas and liquid through pores or channels distributed of constructed on the body and where said cathode is not an integral part of said ion exchange membrane, said anode chamber having an inlet for supplying brine and said cathode chamber having an inlet for supplying an oxygen-containing gas.

4. The electrolytic cell of claim 3, wherein said gas diffusion layer consists essentially of carbon powder and a water repellent material where the catalyst layer is on a side of said gas diffusion layer in contact with said ion exchange membrane and said catalyst layer consists essentially of carbon powder and polytetrafluoroethylene.

* * * * *